United States Patent [19]

Engel et al.

[11] 4,199,969

[45] Apr. 29, 1980

[54] TUBE SWAGING MACHINE

[75] Inventors: Zbigniew Engel, Wieliczka; Marek Kepiński, Sosnowiec; Idzi Grabowski, Bytom, all of Poland

[73] Assignee: Osredek Badawczo-Rozwojowy Maszyn Hutniczych, Bytom, Poland

[21] Appl. No.: 872,458

[22] Filed: Jan. 25, 1978

[30] Foreign Application Priority Data

Feb. 3, 1977 [PL] Poland ..... 195832

[51] Int. Cl.[2] ..... B21D 31/06; B21J 7/16

[52] U.S. Cl. ..... 72/76; 72/402

[58] Field of Search ..... 72/DIG. 20, DIG. 29, 72/76, 77, 121, 402

[56] References Cited

U.S. PATENT DOCUMENTS

| | | | |
|---|---|---|---|
| 3,495,427 | 2/1970 | Balamuth | 72/DIG. 20 |
| 3,812,699 | 5/1974 | Koost et al. | 72/76 |

FOREIGN PATENT DOCUMENTS

| | | | |
|---|---|---|---|
| 729708 | 12/1966 | Italy | 72/77 |
| 723433 | 2/1955 | United Kingdom | 72/402 |
| 1302095 | 1/1973 | United Kingdom | 72/402 |
| 510300 | 5/1976 | U.S.S.R. | 72/402 |

*Primary Examiner*—Ervin M. Combs

*Attorney, Agent, or Firm*—Haseltine, Lake & Waters

[57] ABSTRACT

A tube swaging machine used, in particular, for swaging the ends of tubes or for forging objects of round sections in which hammers are radially arranged relative to a workpiece. The hammers are fixed to a piston in a hydraulic power cylinder, through a piston rod on which a spring is mounted. The hydraulic power cylinder is connected to a vibration generator through a conduit. The vibration generator rotates relative to the workpiece and is mounted on a central shaft. The latter is held in bearings in a housing, and is driven through transmission by a motor which may be in the form of a hydraulic motor. The vibration generator is provided with nozzles, and a screen is mounted on an auxillary shaft having a rotational speed and direction which are independent of the rotational speed and direction of the central shaft.

6 Claims, 2 Drawing Figures

TUBE SWAGING MACHINE

BACKGROUND OF THE INVENTION

The present invention relates to a swaging machine designed for swaging the tube ends or for forging workpieces of circular or near-circular sections.

A known tube swaging machine has four double-arm levers different lengths, which are equipped with swaging tools. Levers are set in a swinging motion by means of a system of cams mounted on a common driveshaft.

Another known tube swaging machine, according to Polish patent application P-163772, is provided with double-arm levers, which are set in a swinging motion by means of eccentrics, arranged radially relative the drive shaft; each of these eccentrics is mounted on a separate shaft provided with a gear engaging gear mounted on the main drive shaft of the swaging machine.

The object of the invention is to achieve a device of such a design which would ensure reliability of operation while maintaining simple machine construction.

This object has been achieved by providing the swaging machine for swaging the tube ends or for forging the objects of circular or near-circular sections with hammers arranged radially relative the work-piece and attached to a piston of a hydraulic power cylinder by means of a piston rod, on which a spring is fitted.

Hydraulic power cylinders are connected with a vibration generator by means of tubing and the whole device, including the vibration generator, rotates relative to the workpiece and is fitted on a central shaft, which is mounted on bearings in a housing.

The central shaft is driven through a transmission by means of a known motor and most advantageously by a hydraulic motor. The vibration generator is provided with nozzles, opposite which, at the side of their outflow ports a diaphragm radially situated. The screen or diaphragm is fitted on a shaft, which is driven by a known motor through a gear transmission. The speed and direction of rotation of the shaft are independent of the speed and direction of rotation of the central shaft.

The design of the machine is simple and ensures high reliability of operation. This results from the fact, that the elements indirectly transmitting the drive for the working tool, such as all kinds of levers and cams of complex profiles, which also require highly accurate machining, have to the maximum possible degree been eliminated.

In the design proposed according to the invention, the reciprocating pistons and hammers, and the known and proven systems driving and rotating the device are the only interacting elements.

Due to employing the rotary motion of the forging tools, the necessity to provide a complex work-piece rotating mechanism has been eliminated. Thus, the design of a workpiece feeding device has become considerably simpler and further, in the case of tube end swaging, the tube surface damages resulting from the tube striking a roller of the feeder table, are avoided.

The proposed solution allows for total automation of the swaging process.

BRIEF DESCRIPTION OF THE DRAWINGS

An example of the subject of the invention is presented in the enclosed drawing.

DESCRIPTION OF THE PREFERRED EMBODIMENTS

Figure 1:
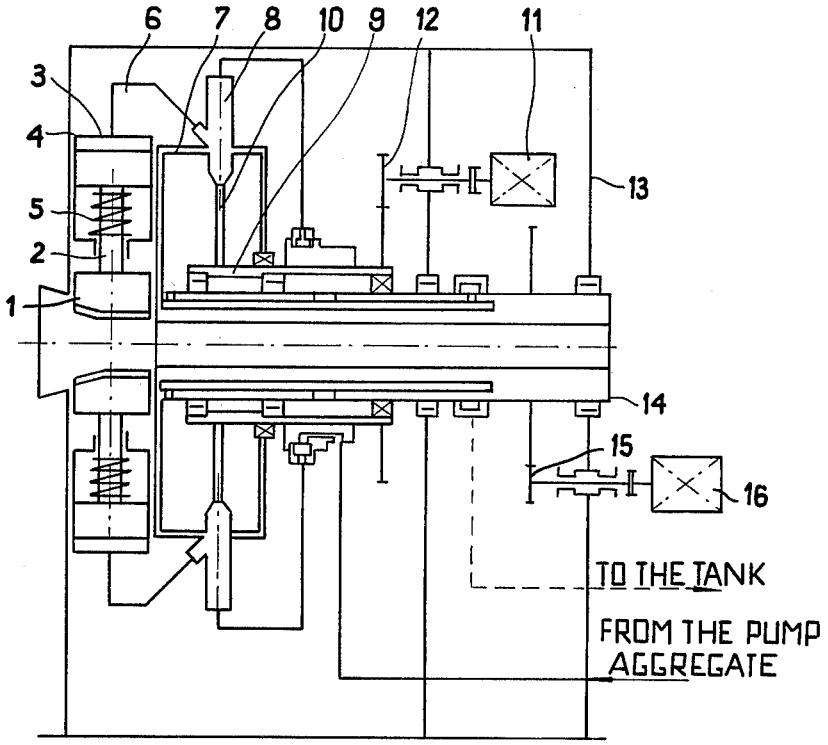
FIG. 1 of the drawing shows a schematic longitudinal section of the swaging machine.
Figure 2:
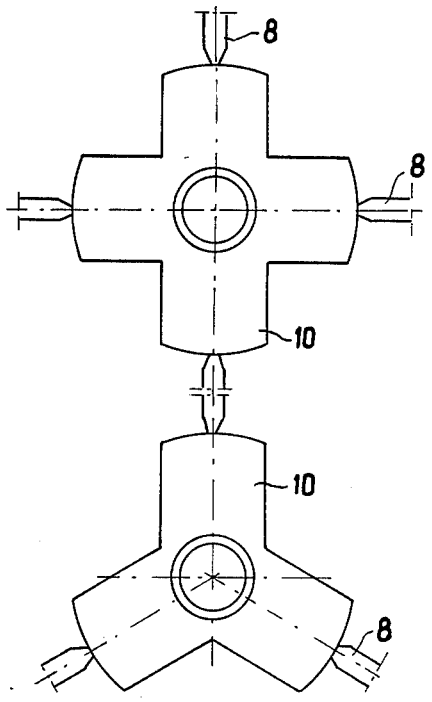
FIG. 2 shows the shape of the screen of the vibration generator nozzle ports.

The swaging machine swaging the tube ends or for forging other work has hammers arranged radially relative to the workpiece and attached to the piston rod 2 of the piston 3 of the hydraulic power cylinder, while the spring 5 is fitted on the piston rod 2. Hydraulic power cylinders, the number of which depends on the employed manufacturing process, are connected to the vibration generator 7 by means of conduits 6. Vibration generator 7 is provided with the nozzles 8, opposite which, at the side of their outflow ports, the screen 10 is mounted on the shaft 9. Shape of the screen varies depending upon the type of the machine operation. Shaft 9 is driven by the motor 11 through a known gear transmission 12. The whole device, including the vibration generator, is mounted on the central shaft 14, which rotates in bearings in the housing 13. Central shaft 14 is driven by a known motor 16, a hydraulic motor, through a single-speed transmission 15.

The above described tube swaging machine operates in the following way:

Shaft 9 of the vibration generator 7 is set in rotary motion by means of the motor 11 and geared transmission 12. Screen 10 fitted on the shaft 9 periodically screens off the outflow ports of the nozzles 8. Screening off the outflow ports of the nozzles generates pulsatory changes in the pressure of the hydraulic fluid. Vibration generator 7 is connected by means of the conduit 6 with the hydraulic power cylinder 4, in which the hydraulic fluid supplied under pressure sets the piston 3 in motion.

This results in the simultaneous movement towards the workpiece of the hammer 1, fitted on the piston rod 2. Return movement of the piston is provided by the spring 5, fitted on the piston rod 2. A hydraulic device may provide the spring action.

The whole device, including the vibration generator rotates relative to the work-piece and is fitted on the central shaft 14, which is mounted in bearings in the housing 13. Central shaft 14 is driven by means of a hydraulic motor.

Rotation speed of the device is independent of the rotation speed of the shaft 9 onto which the screen 10 is fitted.

Depending upon the profile of the workpiece, hammers of a different shape can be used; their number also depends on this profile.

Four hammers, radially arranged relative to the workpiece, are most often used.

Those hammers operate either simultaneously or alternately in pairs.

The work cycle of the hammers depends upon the shape of the screen.

Frequency of vibrations is controlled by changing the speed of the shaft on which the screen is fitted whereas amplitude of vibrations and forces acting upon the pistons depend upon the output of a pump and the pressure of the hydraulic fluid.

The device in accordance with the present invention permits adapting pump delivery and hydraulic pressure to the required needs.

We claim:

1. A tube swaging machine, particularly a machine for swaging ends of tubes for forging objects of substantially round sections, comprising: hammer means radially arranged relative to a workpiece; hydraulic power cylinder and piston means; said piston means being fixed to said hammer means, said piston means having a piston rod mounting spring means for providing a return stroke of the piston; vibrating generator means; conduit means connecting said hydraulic power cylinder to said generator means; said vibration generator means rotating relative to said workpiece; a housing with bearings; a rotary central shaft mounted in said bearings in said housing and carrying said vibration generator; motor means with transmission means; said central shaft being driven through said transmission means by said motor means, said hammer means being hydraulically driven through an impulse generated by said vibration generator means and transmitted by working fluid, said vibration generator means having nozzles into which the working fluid is pumped, parts of said nozzles on an outflow port side thereof being screened periodically by means on said auxiliary shaft, flow of working fluid occurring through conduits into hydraulic power cylinders at the instant that the outflow port is screened for advancing movement of said hammer means on said piston means.

2. A tube swaging machine as defined in claim 1 wherein said motor means comprises a hydraulic motor.

3. A tube swaging machine as defined in claim 1 including auxiliary motor means with auxiliary transmission means; a rotary auxiliary shaft driven by said auxiliary motor means through said auxiliary transmission means; screen means radially mounted on said auxiliary shaft opposite said nozzles at a side of outflow ports of said nozzles; said auxiliary shaft being driven independently of said rotary central shaft.

4. A tube swaging machine as defined in claim 3 wherein said screen means has four arms equally spaced apart.

5. A tube swaging machine as defined in claim 3 wherein said screen means has three arms equally spaced apart.

6. A tube swaging machine, particularly a machine for swaging ends of tubes for forging objects of substantially round sections, comprising: hammer means radially arranged relative to a workpiece; hydraulic power cylinder and piston means; said piston means being fixed to said hammer means, said piston means having a piston rod mounting spring means for providing a return stroke of the piston; vibration generator means; conduit means connecting said hydraulic power cylinder to said generator means; said vibration generator means rotating relative to said workpiece; a housing with bearings; a rotary central shaft mounted in said bearings in said housing and carrying said vibration generator; motor means with transmission means; said central shaft being driven through said transmission means by said motor means; nozzles on said generator means; auxiliary motor means with auxiliary transmission means; a rotary auxiliary shaft driven by said auxiliary motor means through said auxiliary transmission means; screen means radially mounted on said auxiliary shaft opposite said nozzles at a side of outflow ports of said nozzles; said auxiliary shaft being driven independently of said central shaft; said vibration generator means generating vibration impulses transmitted through hydraulic fluid and subsequently through said hydraulic power cylinder and piston means to said hammer means for setting said hammer means into reciprocating motion with predetermined frequency and power, the frequency being regulated by a selected rotating speed and a selected shape of said screen means, said vibration generator means applying kinetic energy of a column of fluid so that basic vibrations of predetermined frequency are modulated by the vibrations of the fluid column between said cylinder and said nozzles of said vibration generator means, said nozzles providing hydraulic amplification for reducing power consumption of the machine.

* * * * *